US008567290B2

(12) United States Patent
Moreau et al.

(10) Patent No.: US 8,567,290 B2
(45) Date of Patent: Oct. 29, 2013

(54) RETROFIT SYSTEM FOR TETHERING A HAND TOOL

(76) Inventors: Darrell A. Moreau, Manchester, NH (US); Andre W. Moreau, Spring Hill, FL (US)

( * ) Notice: Subject to any disclaimer, the term of this patent is extended or adjusted under 35 U.S.C. 154(b) by 234 days.

(21) Appl. No.: 12/986,319

(22) Filed: Jan. 7, 2011

(65) Prior Publication Data

US 2012/0174342 A1 Jul. 12, 2012

(51) Int. Cl.
*B25B 13/58* (2006.01)

(52) U.S. Cl.
USPC ..... 81/180.1; 81/184; 248/309.1; 248/682

(58) Field of Classification Search
USPC ..... 248/309.1, 51, 52, 682, 693, 76, 483, 248/408, 73; 411/999; 24/3.1; 81/436, 460, 81/80.1, 184
See application file for complete search history.

(56) References Cited

U.S. PATENT DOCUMENTS

| | | | | |
|---|---|---|---|---|
| 1,402,391 | A * | 1/1922 | Baldus | 7/128 |
| 4,016,314 | A * | 4/1977 | Cowans et al. | 428/13 |
| 5,086,880 | A * | 2/1992 | Pearce | 187/413 |
| 5,332,240 | A * | 7/1994 | Bedoian | 279/147 |
| 5,555,137 | A * | 9/1996 | Whiting | 359/872 |
| 5,806,380 | A * | 9/1998 | Wilsey | 81/3.09 |
| 6,505,488 | B1 * | 1/2003 | Princell | 70/259 |
| 6,682,282 | B2 * | 1/2004 | Allen | 411/353 |
| 6,813,976 | B2 | 11/2004 | Malvini et al. | |
| 7,665,700 | B2 * | 2/2010 | Taba et al. | 248/231.9 |
| 2003/0102342 | A1 | 6/2003 | Fogg | |
| 2008/0155788 | A1 * | 7/2008 | Wilcox | 24/3.1 |
| 2008/0163464 | A1 | 7/2008 | Baumann | |
| 2008/0255614 | A1 | 10/2008 | Menoudakos | |
| 2010/0229347 | A1 | 9/2010 | Kish | |
| 2011/0265614 | A1 * | 11/2011 | Christensen et al. | 81/489 |
| 2012/0137839 | A1 * | 6/2012 | Mullins | 81/180.1 |

FOREIGN PATENT DOCUMENTS

JP 09-272077 A 10/1997

OTHER PUBLICATIONS

PCT International Search Report for PCT/US2011/022805, mailed Jan. 19, 2012.

* cited by examiner

*Primary Examiner* — Nkeisha Smith
(74) *Attorney, Agent, or Firm* — Robert R. Deleault, Esq.; Mesmer & Deleault, PLLC

(57) ABSTRACT

A retrofit system for tethering a hand tool includes a tool collar having a collar body, a first body end, a second body end, and a bore extending longitudinally therethrough, and a tethering tab having a first tab opening and a second tab opening transverse to the longitudinal axis of the tethering tab. The bore of the tool collar has a cross-sectional area that is less than the cross-sectional area of a first tool portion of the hand tool providing a snug fit of the tool collar on the first tool portion. The second tab opening of the tethering tab being spaced from the first tab opening and the first tab opening having a cross-sectional area larger than the cross-sectional area of the first tool portion providing for free rotation of the tethering tab around the first tool portion.

13 Claims, 6 Drawing Sheets

Fig. 2
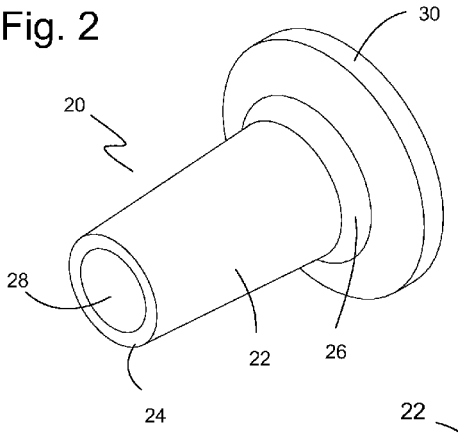
Fig. 3
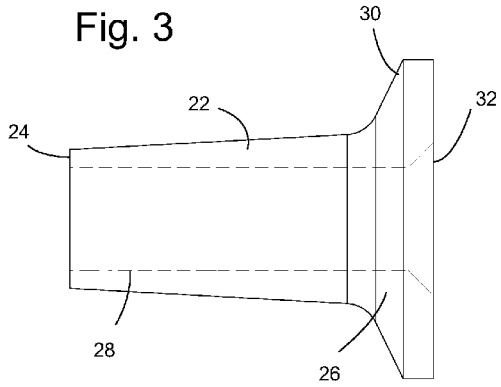
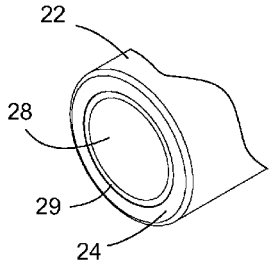
Fig. 2A

RETROFIT SYSTEM FOR TETHERING A HAND TOOL

BACKGROUND OF THE INVENTION

1. Field of the Invention

The present invention relates generally to hand tools. Particularly, the present invention relates to hand tools and tethering of the same.

2. Description of the Prior Art

It is a generally accepted safety practice to secure a workman's tools in some manner when working from a ladder or above ground level. Over the years different types of devices for preventing the accidental dropping and/or loss of a tool and a tool accessory have been attempted when working in overhead situations. A dropped tool or tool accessory could be hazardous for personnel working below or the dropped tool or tool accessory could potentially damage a vital piece of equipment. This can occur when the tool is mishandled, bumped, or jarred, becoming dislodged from the users hand and free to fall to whatever is beneath the worker. In some cases, this can be a passerby, another worker or even vital plant equipment.

Typically, the tools are secured to the worker with a tether or in a holster of some sort. Generally, tethers are lightweight, optionally retractable, and have light duty snap hooks at each end for snap connection to the tool and to the worker's belt or harness. Some such tethers even use plastic snaps. In some cases a loop is formed around the worker's wrist with the free end having a snap connectable to a tool. Others have disclosed the use of hook and loop type fasteners to secure the tool to the worker's hand. The use of such safety tethers and lanyards is becoming increasingly necessary, especially in industrial centers where workers are constantly exposed to the hazards of falling tools, sometimes from many feet.

Many attempts have been made to secure tools to tethers and users. Some are successful and easy to use while others are makeshift and lack the quality needed to sustain heavier tools. Devices have been created to allow for lanyard attachment to hand tools. Some devices include using eye hooks, or D-rings with webbing secured by tape or heat shrink tubing. Other devices are tubular and used over the butt end of screw drivers and other tools with handles such as, for example, pliers, hammers, cutters, etc. These tubular devices are normally heat shrinkable onto the tool or are self-insertable device made of a resilient material that provides a suction force when the tool handle or butt end is inserted into the tubular device. The suction force created upon insertion of the tool into the tubular device prevents the tool from being easily pulled out or separated from the tubular device.

In some cases, provisions are made on the tool itself for making such attachments. In most cases when tools are provided with an eyelet, however, it is typically provided as a means for storing on a wall hook or the like.

Therefore, what is needed is a system that will retrofit a hand tool for coupling to a tool lanyard or tether.

SUMMARY OF THE INVENTION

Currently available retrofit systems are tubular devices that typically use an eyelet secured to the tool intended to be tethered. There are disadvantages to these tubular retrofit systems. The eyelet is always attached to the non-working end of the tubular device or the tool. For example, when used on screw drivers, the eyelet interferes with the full usefulness of the tool. With most screw drivers, the butt end is designed to fit in the palm of the user's hand to allow the user to press down while tightening or loosening a screw. If the eyelet is at the end of the tool, this cannot be accomplished successfully. This is also true for other types of tools such as pliers, hammers, other hand tools, and the like where the palm of the user's hand grips the end of the tool to apply gripping pressure and/or transfer greater impacting force through the tool. For tubular devices relying on the suction caused by insertion of the tool into the tubular, flexible material, another disadvantage arises. For these devices, the suction force holding the tool such as a screw driver to the tethering device may be abruptly relieved when attempting to pull/remove the screw driver from the tethering device. This abrupt release causes the tool to quickly release with accelerating force due to the amount of force required to pull the screw driver or other tool necessary to counter the suction force created when applying the tubular device to the tool. If a tool has a sharp end such as most screw drivers, the user/worker and/or bystander could be injured.

It is an object of the present invention to provide a retrofit system for tethering a tool. It is another object of the present invention to provide a retrofit system for tethering a tool that allows for the full intended use of the tool. It is a further object of the present invention to provide a retrofit system for tethering a tool that minimizes the entanglement of the tool lanyard with the tool during use.

The present invention achieves these and other objectives by providing a retrofit system that includes a tool collar and a tethering tab. In one embodiment, the tool collar has a collar body, a first body end, a second body end, and a bore extending longitudinally therethrough and a tethering tab having a first tab opening and a second tab opening where the tab openings are transverse to the longitudinal axis of the tethering tab. The bore has a cross-sectional area that is less than the cross-sectional area of a first tool portion of the hand tool providing a snug fit of the tool collar on the first tool portion. The second tab opening of the tethering tab is spaced from the first tab opening where the first tab opening has a cross-sectional area larger than the cross-sectional area of the first tool portion providing for free rotation of the tethering tab around the first tool portion.

In another embodiment of the present invention, the second body end of the tool collar has a skirt that extends transversely away a predefined distance from the collar body.

In a further embodiment of the present invention, the second tab opening of the tethering tab is spaced from the first tab opening a predefined distance sufficient to position the second tab opening beyond the largest cross-section of the tool collar when the tool collar and the tethering tab are connected to the hand tool to be tethered.

In still another embodiment of the present invention, the second body end of the tool collar has a longitudinally-extending flange having a diameter smaller than the first tab opening of the tethering tab and a length greater than the thickness of the tethering tab.

In another embodiment of the present invention, the tool collar is made of a resilient material and the tethering tab is made of a rigid or semi-rigid material.

In another embodiment of the present invention, the tool collar is made of a rigid or semi-rigid material with a bore liner or coating made of a resilient material.

In yet another embodiment of the present invention, a retrofit kit for tethering a hand tool is disclosed. The kit includes a tool collar made of a resilient material, a tethering tab and instructions for assembling the tool collar and the tethering tab to the hand tool.

In a further embodiment of the present invention, a method of retrofitting a hand tool for use with a tool lanyard is disclosed. The method includes providing a hand tool having a first tool portion and a second tool portion, providing a tethering tab and a tool collar of a retrofit system for tethering a hand tool, sliding a first tab opening of the tethering tab over a first tool portion of the hand tool to a predefined position on the first tool portion, forcibly attaching the tool collar to the first tool portion of the hand tool by inserting the first tool portion into a longitudinal bore at a second end of the tool collar, and forcibly sliding the tool collar a predefined distance along the first tool portion until the second end of the tool collar is adjacent the tethering tab and positioned to permit the free rotation of the tethering tab about the first tool portion.

In another embodiment of the present invention, the method further includes forcibly sliding a tool collar along the first tool portion before the step of sliding the tethering tab to a position on the first tool portion beyond but adjacent to the predefined distance described in the step of sliding the tethering tab.

BRIEF DESCRIPTION OF THE DRAWINGS

FIG. 2 is a perspective view of one embodiment of a tool collar illustrated in FIG. 1.

FIG. 2A is an enlarged, partial perspective view of the first body end of the tool collar showing the liner in the bore of the tool collar when the tool collar is made of a rigid or semi-rigid material.

FIG. 3 is a side view of the embodiment of the tool collar illustrated in FIG. 2 showing a tapered elongated collar body.

DETAILED DESCRIPTION OF THE PREFERRED EMBODIMENT

Figure 1:
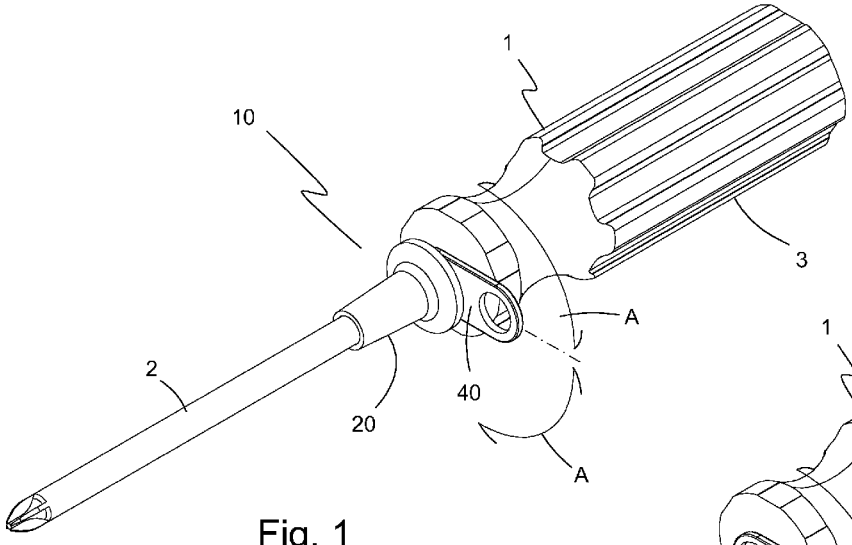
FIG. 1 is a perspective view of one embodiment of the present invention retrofit to a screw driver.
Figure 1A:
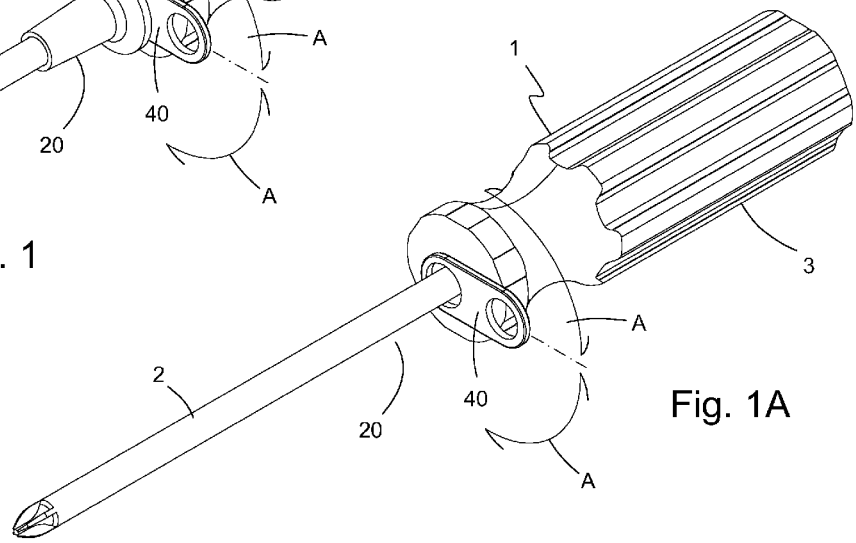
FIG. 1A is a perspective view of the embodiment in FIG. 1 showing the present invention with the tool collar removed to illustrate the tethering tab on the first tool portion.
Figure 4:
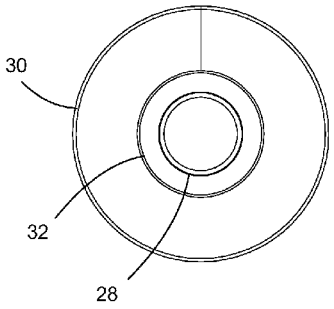
FIG. 4 is a rear view of the tool collar illustrated in FIG. 2 showing the recess into the collar body from the second collar end.

The preferred embodiment(s) of the present invention is illustrated in FIGS. 1-10. FIG. 1 illustrates one embodiment of a retrofit system 10 of the present invention connected to a hand tool 1. Retrofit system 10 includes a tool collar 20 and a tethering tab 40. As illustrated, tethering tab 40 is mounted on a first tool portion 2 adjacent a second tool portion 3 of hand tool 1. In FIG. 1, hand tool 1 is represented by a screw driver. Tethering tab 40 freely rotates around first tool portion 2, which is indicated by arrows A. FIG. 1A shows tethering tab 40 without tool collar 20 on hand tool 1 to more clearly show the rotational relationship between tethering tab 40 and first tool portion 2. When a lanyard/tether (not shown) is connected to tethering tab 40, the free rotation of tethering tab 40 around first tool portion 2 does not interfere with the use of hand tool 1. The freely rotating tethering tab 40 permits rotation of hand tool 1 when inserting or removing a screw fastener (not shown) without causing the lanyard/tether to twist or tangle on itself or with/around hand tool 1. Furthermore, a user will typically apply force using the palm of the hand to the end of second working portion 3 (also known as the handle of the screw driver) of hand tool 1 while tightening or loosening a screw fastener. The present invention permits full use of the tool without interference with such use.

FIG. 2 illustrates a perspective view of one embodiment of tool collar 20. In this embodiment, tool collar 20 has a collar body 22, a first body end 24, a second body end 26, and a bore 28 extending longitudinally therethrough. Bore 28 has a cross-sectional area that is less than the cross-sectional area of first tool portion 2 of hand tool 1 providing a snug fit of tool collar 20 on first tool portion 2. Tool collar 20 may optionally also include a skirt 30 that extends transversely away from the circumference of second body end 26. Skirt 30 extends a predefined distance to provide a larger cross-sectional area at second body end 26 for retaining tethering tab 40 on first tool section 2 of hand tool 1.

FIG. 3 illustrates a side view of tool collar 20 shown in FIG. 2. As can be seen, bore 28 extends through the entire length of tool collar 20. Second body end 26 may optionally include a recess 32 forming a tapered opening 33 that is axially aligned with bore 28. Optional tapered opening 33 facilitates centering of the first tool portion 2 into bore 28 when tool collar 20 is forcibly slid onto first tool portion 2 from second from end 26. This is more clearly shown in FIG. 4, which is rear view of tool collar 20. Tool collar 20 is preferably made of a resilient material but may also be made of a rigid or semi-rigid material so long as bore 28 has a layer or insert or liner 29 of a resilient material securely attached to bore 28 to provide a snug fit between tool collar 20 and first tool portion 2. FIG. 2A illustrates an enlarged view of first body end 24 showing the liner 29. Examples of acceptable materials include rubber, silicone and materials having the same or similar resilient characteristics.

Figure 5:
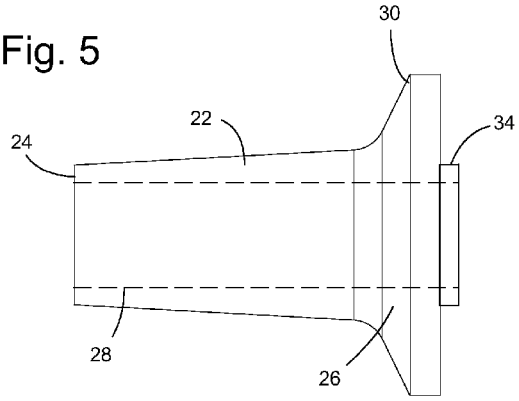
FIG. 5 is a side view of another embodiment of the tool collar of the present invention.

FIG. 5 illustrates a side view of another embodiment of tool collar 20. In this embodiment, tool collar 20 includes a collar body 22, a first body end 24, a second body end 26, and a bore 28 extending longitudinally therethrough. Like the tool collar shown in FIG. 2, bore 28 has a cross-sectional area that is less than the cross-sectional area of first tool portion 2 of hand tool 1 providing a snug fit of tool collar 20 on first tool portion 2. Tool collar 20 may optionally also include a skirt 30 that extends transversely away from the circumference of second body end 26. Skirt 30 extends a predefined distance to provide a larger cross-sectional area at second body end 26 for retaining tethering tab 40 on first tool section 2 of hand tool 1. Also provided in this embodiment is an optional flange 34. Optional flange 34 extends longitudinally from second body end 26 and has a length greater than the thickness of tethering tab 40.

Figure 6:
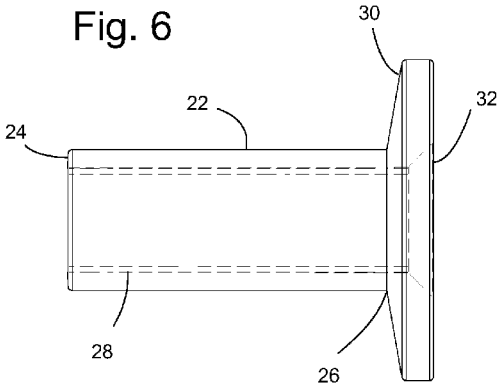
FIG. 6 is a side view of another embodiment of a tool collar of the present invention showing a straight elongated collar body.

FIG. 6 illustrates a side view of another embodiment of tool collar 20. In this embodiment, tool collar 20 has a straight, elongated collar body 22. This configuration reduces the amount of material used in tool collar 20 but may provide the transition between skirt 30 and collar body 22 with less strength. This becomes important when the force applied to tool collar 20 for seating tool collar to the predefined location on first tool portion 2 is applied to skirt 30 instead of collar body 22. Depending on the amount of force applied to skirt 30 and the amount of resistance caused by the snug fit of bore 28 around first tool portion 2, this transition point could tear.

Figure 7:
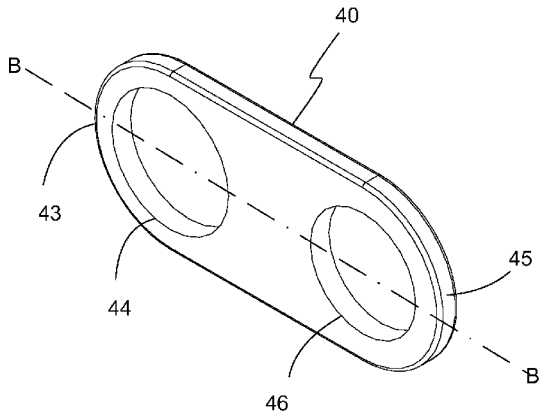
FIG. 7 is a perspective view of one embodiment of a tethering tab illustrated in FIG. 1.
Figure 8:
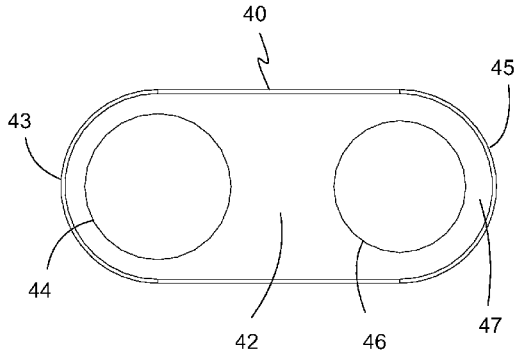
FIG. 8 is a front view of the embodiment of the tethering tab illustrated in FIG. 5.

FIGS. 7 and 8 illustrate one embodiment of tethering tab 40. Tethering tab 40 includes a tab body 42 with a first tab end 43 and a second tab end 45, a first tab opening 44 and a second tab opening 46 where tab openings 44, 46 are transverse to the longitudinal axis B-B of tethering tab 40. Second tab opening 46 is spaced from first tab opening 44 and both tab openings 44, 46 extend completely through tab body 42. First tab opening 44 has a cross-sectional area larger than the cross-sectional area of first tool portion 2 to provide for free rotation of tethering tab 40 around first tool portion 2. Second tab opening 46 is spaced from second tab end 45 providing a retaining edge 47 around which a tether clip (not shown) is attached. The size of first tab opening 44 to second tab opening 46 is dependent on the diameter of first tool portion 2 and the size of the tether clip. Although tethering tab 40 shown in FIGS. 7 and 8 have semi-circularly shaped first and second tab ends 43 and 45, respectively, it is contemplated that the shape of first and second tab ends 43, 45 may be any configuration so long as tethering tab 40 can be used for its intended purpose. The intended purpose being that tethering tap 40 is connectable to a first tool portion 2 and can freely rotate about first tool portion 2 while presenting a second tab end 45 for attachment to the clip of a tool tether. It is also contemplated that the peripheral shape of tethering tab 40 may also have any configuration so long as tethering tab 40 can be used for its intended purpose. Tethering tab 40 is made of a rigid or semi-rigid material. Examples of such materials are metal, plastic and the like.

Figure 9:
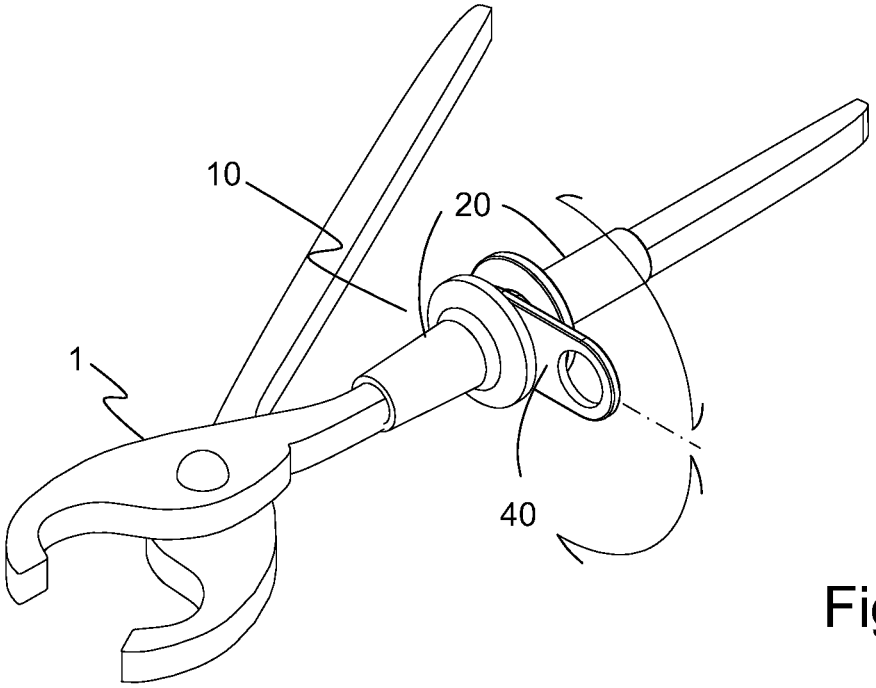
FIG. 9 is a perspective view of another embodiment of the present invention retrofit to a pair of pliers showing use of two tool collars.

For tools that offer an abrupt change in cross-sectional area between first tool portion 2 and second tool portion 3, only one tool collar 20 is necessary so that tethering tab 40 is "sandwiched" between second collar end 26 and second tool portion 3. For tools that do not have an abrupt change in cross-sectional area between first tool portion 2 and second tool portion 3, a second tool collar 20 is used to "sandwich" tethering tab 40 therebetween. FIG. 9 illustrates one example of a tool that may require two tool collars 20. As can be seen, second collar ends 26 are opposed to each other with tethering tab 40 therebetween. In this embodiment, tethering tab 40 also freely rotates around first tool portion 2.

Figure 10:
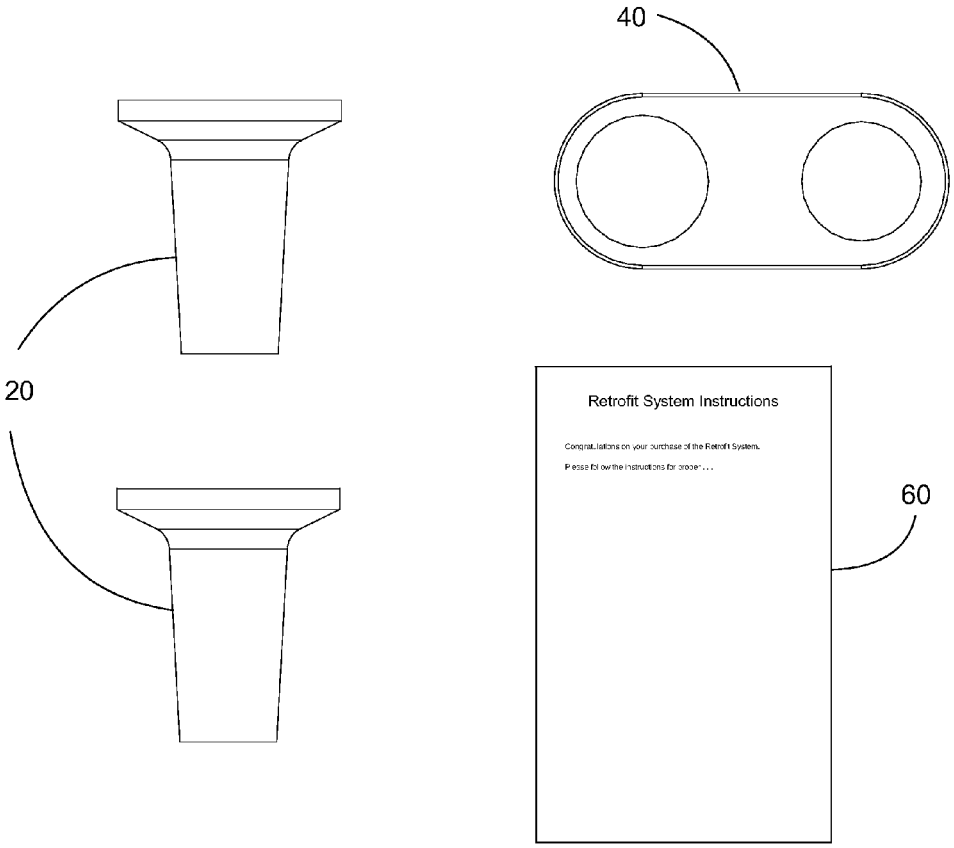
FIG. 10 is a plan view of one embodiment of a retrofit system kit for tethering a hand tool.

FIG. 10 illustrates a plan view of a kit containing the retrofit system 10 of the present invention. The kit contains one or more tool collars 20, a tethering tab 40 and instructions 60 for attaching the one or more tool collars 20 and the tethering tab 40 to a hand tool.

To use the present invention, a hand tool 1 that is not equipped to be attached to a tool lanyard but is to be retrofitted for attaching a tool lanyard is provided. For a hand tool that has an abrupt change is cross-sectional area between a first tool portion 2 and a second tool portion 3 such as, for example, a screw driver, first tab opening 44 of tethering tab 40 is slid onto first tool portion 2 up to and adjacent to second tool portion 3. Next, bore 28 of second body end 26 of tool collar 20 is forcibly slid onto first tool portion 2 to a predefined distance adjacent tethering tab 40 so as to permit tethering tab 40 to freely rotate around first tool portion 2. The snug fit of tool collar 20 prevents tethering tab 40 from sliding off of first tool portion 2.

For a hand tool that does not have an abrupt change in cross-sectional area between a first tool portion 2 and a second tool portion 3 such as, for example, a pair of pliers, a bore 28 of a first body end 24 of tool collar 40 is forcibly slid onto first too portion 2 to a predefined distance. Next, first tab opening 44 of tethering tab 40 is slid onto first tool portion 2 up to and adjacent to second body end 26 of tool collar 20 that was already installed on first tool portion 2. Next, bore 28 of second body end 26 of another tool collar 20 is forcibly slid onto first tool portion 2 to a predefined distance adjacent tethering tab 40 so as to permit tethering tab 40 to freely rotate around first tool portion 2 between the first tool collar 20 and the second tool collar 20. The snug fit of the first and second tool collars 20 prevents tethering tab 40 from sliding off of first tool portion 2.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A retrofit system for tethering a hand tool, the system comprising:

a tool collar having a collar body, a first body end, a second body end, a skirt at the second body end that extends a predefined distance transversely away from the collar body, and a bore extending longitudinally therethrough, the bore having a cross-sectional area that is less than a cross-sectional area of a first tool portion of the hand tool and providing a snug fit of the tool collar on the first tool portion;

a tethering tab having a first tab opening and a second tab opening transverse to a longitudinal axis of the tethering tab, the second tab opening being spaced from the first tab opening, the first tab opening having a cross-sectional area larger than the cross-sectional area of the first tool portion providing for free rotation of the tethering tab around the first tool portion; and wherein the skirt of the tool collar is adapted to retain the tethering tab on the first tool portion while permitting the free rotation of the tethering tab around the first tool portion.

2. The system of claim 1 wherein the second tab opening is spaced from the first tab opening a predefined distance sufficient to position the second tab opening beyond a largest cross-section of the tool collar when the tool collar and the tethering tab are connected to the tool to be tethered.

3. The system of claim 1 further comprising a longitudinally-extending flange at the second body end having a diameter smaller than the first tab opening of the tethering tab and a length greater than the thickness of the tethering tab.

4. The system of claim 1 wherein the tool collar is made of a resilient material.

5. The system of claim 1 wherein the tool collar is made of a rigid or semi-rigid material and contains a liner fixed in the bore.

6. The system of claim 1 wherein the tethering tab is made of a rigid or semi-rigid material.

7. The system of claim 5 wherein the tethering tab is made of a material selected from the group consisting of metal, plastic and composite.

8. A retrofit kit for tethering a hand tool, the kit comprising:

a tool collar made of a resilient material having a collar body, a first body end, a second body end, a skirt on the second body end that extends a predefined distance transversely away from the collar body, and a bore extending longitudinally therethrough, the bore having a cross-sectional area that is less than a cross-sectional area of a first tool portion of the hand tool and providing a snug fit of the tool collar on the first tool portion;

a tethering tab having a first tab opening and a second tab opening transverse to a longitudinal axis of the tethering tab, the second tab opening being spaced from the first tab opening, the first tab opening having a cross-sectional area larger than the cross-sectional area of the first tool portion providing for free rotation of the tethering tab around the first tool portion, wherein the skirt of the tool collar is adapted to retain the tethering tab on the first tool portion while permitting the free rotation of the tethering tab around the first tool portion; and instructions for assembling the tool collar and the tethering tab to the hand tool.

9. The kit of claim 8 further comprising a second tool collar and instructions for use of the second tool collar when required.

10. The kit of claim 8 wherein the second body end of the tool collar has a longitudinally-extending flange having a diameter smaller than the first tab opening of the tethering tab and a length greater than the thickness of the tethering tab.

11. A method of retrofitting a hand tool for use with a tool lanyard, the method comprising:

providing a hand tool having a first tool portion and a second tool portion;

providing a tethering tab and a tool collar of a retrofit system for tethering a tool;

sliding a first tab opening of the tethering tab over a first tool portion of the hand tool to a predefined position on the first tool portion;

forcibly attaching the tool collar to the first tool portion of the hand tool by inserting the first tool portion into a longitudinal bore at a second end of the tool collar; and forcibly sliding the tool collar a predefined distance along the first tool portion until the second end of the tool collar is adjacent the tethering tab and positioned to permit the free rotation of the tethering tab about the first tool portion;

wherein the tool collar is made of a resilient material having a collar body, a first body end, a second body end, a skirt of the second body end that extends a predefined distance transversely away from the collar body, and a bore extending longitudinally through the tool collar, the bore having a cross-sectional area that is less than a cross-sectional area of the first tool portion of the hand tool and provides a snug fit of the tool collar on the first tool portion.

12. The method of claim 11 wherein the predefined position on the first tool portion is adjacent the second tool portion having a diameter greater than the first tab opening of the tethering tab.

13. The method of claim 11 further comprising forcibly sliding a tool collar along the first tool portion before the tethering tab sliding step to a position on the first tool portion beyond but adjacent to the predefined distance in the tethering tab sliding step.

* * * * *